United States Patent [19]

Pilolla

[11] Patent Number: 4,856,122

[45] Date of Patent: Aug. 15, 1989

[54] ANTI-ROTATION DEVICE

[75] Inventor: Joseph J. Pilolla, Elmhurst, Ill.

[73] Assignee: Sloan Valve Company, Franklin Park, Ill.

[21] Appl. No.: 173,884

[22] Filed: Mar. 28, 1988

[51] Int. Cl.[4] ..... F03C 1/04

[52] U.S. Cl. ..... 4/192; 4/623; 137/359; 137/801

[58] Field of Search ..... 4/191, 192, 623; 137/359, 801

[56] References Cited

U.S. PATENT DOCUMENTS 1,960,278 5/1934 Niedecken ..... 4/192

FOREIGN PATENT DOCUMENTS 3301060 8/1983 Fed. Rep. of Germany ..... 4/191

8504684 10/1985 World Int. Prop. O. ..... 4/191

*Primary Examiner*—Edward L. Roberts

*Attorney, Agent, or Firm*—Kinzer, Plyer, Dorn, McEachran & Jambor

[57] ABSTRACT

An anti-rotation device for mounting on a faucet shank on the underside of a basin has a cylindrical body adapted to be keyed to the shank. A pair of diametrically opposed, outwardly directed webs extend from the spacer body. Each includes an adjustable abutment rod threaded to the web for adjusting its length. Free ends of the abutment arms are adapted for engagement with an associated planar surface such as a wall to resist rotation of the spacer body, and, thus, the faucet shank.

9 Claims, 1 Drawing Sheet

Fig. 1.
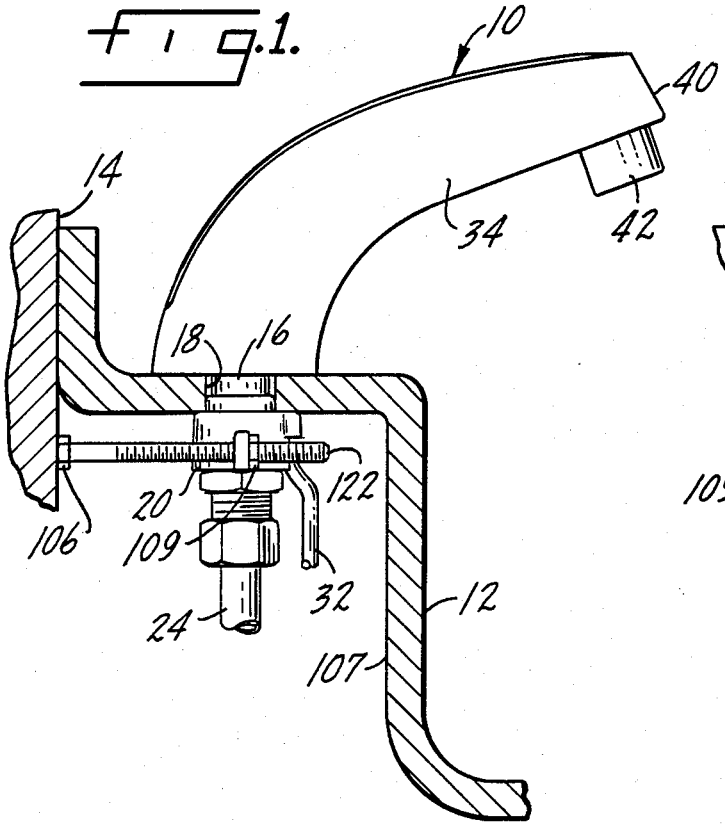
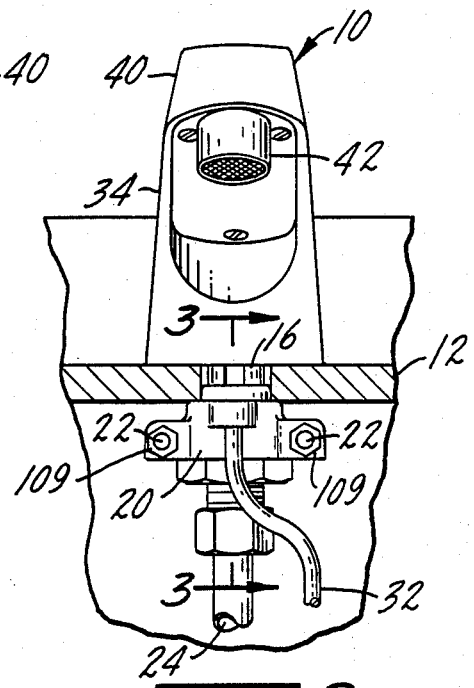
Fig. 2.
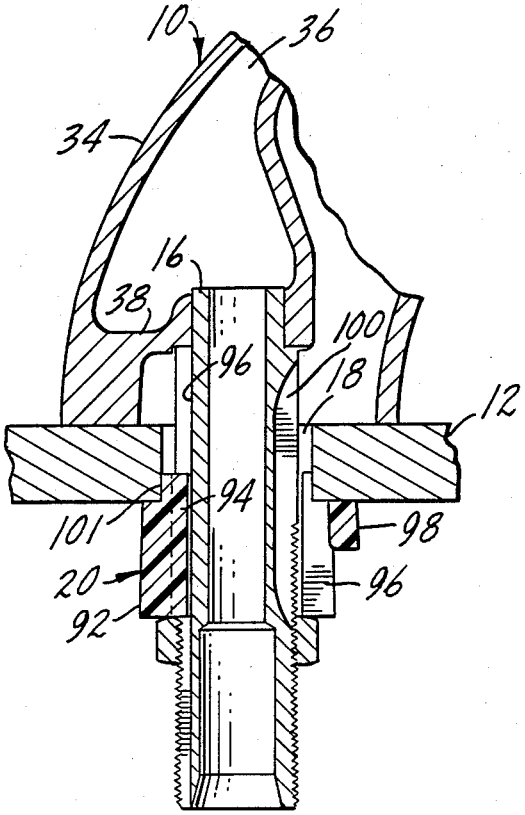
Fig. 3.
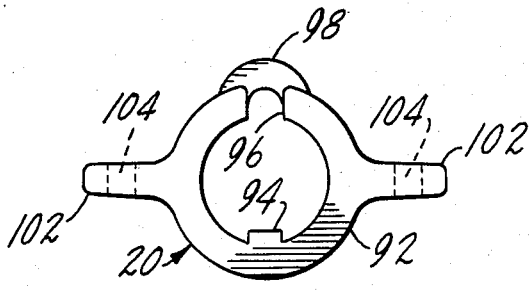
Fig. 4.

ANTI-ROTATION DEVICE

BACKGROUND OF THE INVENTION

This invention relates to a device to resist rotation of a faucet body mounted on a sink. In particular, it relates to such a device which includes means to abut an adjacent vertical surface to resist efforts to rotate a faucet about its base.

Discharge faucets or spouts are often configured such that they can be grasped and intentionally or inadvertently subjected to relatively strong forces causing rotation of the faucet relative to an associated sink or basin. In this regard, commonly available faucets include a base for mounting contact upon a sink surface and an elongated cantilevered spout body extending to a discharge outlet. Such configuration presents a mechanical advantage for multiplication of forces imparted adjacent the discharge outlet in a direction which tends to rotate the faucet about its base. The tendency to rotate is increased in instances where the faucet base is not pinned or otherwise keyed to the associated sink surface.

The present invention provides a device which resists rotational effort imparted to the faucet body.

SUMMARY OF THE INVENTION

Faucets normally include a shank which extends below the base and which is adapted for securement of the faucet to an associated sink or basin. The present invention provides an anti-rotation device in the form of a sleeve adapted to be keyed to the faucet shank. It includes a pair of opposed, outwardly extending webs each of which receives an abutment arm extending laterally outwardly of the sleeve body. The abutment arms are adjustably connected to the webs and include free ends adapted for engagement with an associated planar surface such as a wall. This engagement provides for counteractive forces to the shank to resist rotational forces imparted to the faucet spout body.

DESCRIPTION OF THE DRAWING

FIG. 1 is a side elevational view, partially in section, illustrating the anti-rotation device of the present invention in association with a faucet.

FIG. 2 is a front elevational view of the apparatus illustrated in FIG. 1.

FIG. 3 is a fragmentary sectional view on an enlarged scale of a portion of the apparatus of FIG. 1 taken along the line 3—3 of FIG. 2.

FIG. 4 is a bottom view of the anti-rotation device.

DETAILED DESCRIPTION OF THE INVENTION

A sink includes a faucet 10 mounted on a basin 12 which is attached to a wall 14. The faucet is connected to a shank 16 which extends through a port 18 in the basin. An anti-rotation spacer 20 is fitted about the shank 16 and partially into the port 18. The shank 16 is connected to a water supply line 24.

The faucet includes a faucet body 34 having a mounting base 38 and defining a water passage 36 therein extending from seat 38 to a spout 40. An aerator 42 may be threaded into the spout 40.

The anti-rotation spacer 20 of the present invention is illustrated in FIGS. 1 to 4. The spacer 20 has a generally cylindrical body 92 having a central bore therethrough which allows the spacer to slip onto the faucet shank 16, as best seen in FIG. 1. A key 94 on the interior of the body, best seen in FIG. 4, engages a keyway 96 in the faucet shank to rotationally lock the spacer and shank together. A location ring 101 on the upper surface of the body fits in the port 18 of the basin to centralize the shank with respect to the port.

One side of the spacer has a longitudinal slot 96 which is spanned by a cable guide loop 98. The slot 96 provides ready access to a slot 100 in the shank for threading electrical cable 32 out of the faucet body cavity 44.

A pair of lateral webs 102 extend from opposite sides of the body 92. The webs are vertically disposed and have threaded openings 104 therein to receive threaded abutment arms 122. As can be seen in FIG. 1, the abutment arms extend horizontally and include free ends 106, which are adapted to engage or abut any adjacent rigid vertical surface. In the illustrated embodiment the ends 106 engage wall 14. Alternatively, arms 122 could engage the wall 107 of sink 12.

The abutment arms 122 are threaded into the threaded holes 104 in web 102. They are, therefore, adjustable to reach any adjacent vertical surface. Lock nuts 109 lock the position of the arms once the ends 106 are placed in contact with an adjacent surface.

With the arms 122 positioned as shown in FIG. 1, rotation of faucet 10 about its base is precluded. The spacer 20 is held against rotation by the arms 122 through webs 102. The spacer, in turn, is keyed to shank 16 by key 94.

Whereas a preferred form of the invention has been shown and described, it will be realized that changes may be made thereto without departing from the scope of the following claims.

What is claimed:

1. In a sink having a faucet mounted on a basin with a faucet shank extending through a port in the basin, the shank including a keyway, the improvement comprising an anti-rotation spacer including:

- a generally cylindrical body having a central bore therethrough for mounting the body on the faucet shank on the underside of the basin;
- a key on the interior of the body and engageable with the shank's keyway;
- a pair of webs attached to opposite sides of the body; and
- a pair of arms connected to the webs and adapted to extend to a rigid surface for engagement therewith, the arms being disposed in a plane perpendicular to the shank axis.

2. The spacer of claim 1 further comprising a longitudinal slot in the body and a cable guide loop spanning the slot.

3. The spacer of claim 1 further comprising a locating ring on the upper surface of the body, the locating ring being engageable with the port so that the faucet shank is centralized with respect to the port.

4. The spacer of claim 1 wherein the webs are spaced 180° apart.

5. An anti-rotation device for mounting a faucet to a sink comprising a generally cylindrical body having a central bore therethrough to receive a faucet shank, such body defining means to secure said device to a shank of a faucet to preclude relative rotation therebetween, said body including at least one pair of opposed webs extending therefrom, and arms extending from said webs perpendicular to the longitudinal axis of said bore for engagement with an adjacent rigid surface.

6. An anti-rotation device as claimed in claim 5 wherein said webs are generally vertically disposed and positioned approximately 180° apart.

7. An anti-rotation device as claimed in claim 6 wherein said webs each include threaded holes therein and said arms are adjustably threaded therein.

8. An anti-rotation device as claimed in claim 7 wherein said arms extend generally perpendicularly of the axis of said body.

9. An anti-rotation device as claimed in claim 7 wherein said arm includes a nut to releasably secure said arm at a given length.

* * * * *